US008138942B2

(12) United States Patent
Otsuka et al.

(10) Patent No.: US 8,138,942 B2
(45) Date of Patent: Mar. 20, 2012

(54) REMOTE CONTROL TRANSMITTING DEVICE

(75) Inventors: Kenji Otsuka, Tokyo (JP); Ryuhei Noguchi, Tokyo (JP); Noriaki Miyata, Tokyo (JP)

(73) Assignee: SMK Corporation, Tokyo (JP)

( * ) Notice: Subject to any disclaimer, the term of this patent is extended or adjusted under 35 U.S.C. 154(b) by 515 days.

(21) Appl. No.: 12/405,339

(22) Filed: Mar. 17, 2009

(65) Prior Publication Data

US 2010/0052937 A1 Mar. 4, 2010

(30) Foreign Application Priority Data

Sep. 1, 2008 (JP) ..... 2008-224126

(51) Int. Cl.
*G08B 5/24* (2006.01)

(52) U.S. Cl. ..... 340/815.78; 341/20; 341/22; 341/23; 341/176; 345/168; 345/173; D13/137; D13/168; D13/174; D13/184; D14/218; D14/247; D14/398; D14/400; D14/401

(58) Field of Classification Search ..... 340/815.78; 341/176, 20, 22, 23; 345/168, 173; D13/168, D13/174, 184, 137; D14/218, 400, 401, D14/398, 247
See application file for complete search history.

(56) References Cited

U.S. PATENT DOCUMENTS 2,046,911 A * 7/1936 Barrett ..... 455/354
D232,863 S * 9/1974 Tong ..... D14/192
3,952,612 A * 4/1976 Kurkowski et al. ..... 74/570.21
4,023,435 A * 5/1977 LaDue ..... 74/502.4
4,223,294 A * 9/1980 Moffitt et al. ..... 338/122
4,244,238 A * 1/1981 Suzuki et al. ..... 74/502.6
4,608,841 A * 9/1986 Buck et al. ..... 66/104
D331,060 S * 11/1992 Emmons et al. ..... D14/218
5,233,882 A * 8/1993 Byram et al. ..... 74/514
D346,598 S * 5/1994 McCay et al. ..... D14/137
D371,791 S * 7/1996 Patton ..... D14/218
D371,793 S * 7/1996 Patton ..... D14/218
D375,909 S * 11/1996 Dziersk et al. ..... D10/106.1
D394,626 S * 5/1998 Sacco et al. ..... D12/192
D405,079 S * 2/1999 Oikawa ..... D14/401
D421,975 S * 3/2000 Steel ..... D14/399
6,075,575 A * 6/2000 Schein et al. ..... 348/734
6,088,022 A * 7/2000 Rakoski ..... 345/168
6,211,878 B1 * 4/2001 Cheng et al. ..... 715/760
6,218,044 B1 * 4/2001 Suzuka ..... 429/175
D442,591 S * 5/2001 Bailly ..... D14/398
D450,314 S * 11/2001 Mattis ..... D14/218
D463,404 S * 9/2002 Sadatsuki ..... D14/218
D469,749 S * 2/2003 Kim ..... D14/138 AA (Continued)

FOREIGN PATENT DOCUMENTS

EP 998171 A2 * 5/2000

(Continued)

*Primary Examiner* — George Bugg
*Assistant Examiner* — Paul Obiniyi
(74) *Attorney, Agent, or Firm* — Edwards Wildman Palmer LLP; Peter C. Schechter; Adam P. Daniels

(57) ABSTRACT

An annular operation unit is formed as an outer shape to cover entire outline of a surface of a case, and inputting switches and displaying unit are attached inside of an opening at the center side of the annular operation unit, allowing the annular operation unit to have a size to perform fine rotational operations in case the entire size of the remote control transmitting device is miniaturized.

5 Claims, 7 Drawing Sheets

U.S. PATENT DOCUMENTS

D475,026 S * 5/2003 Buczek et al. ..... D13/168
D481,370 S * 10/2003 Popowski et al. ..... D14/150
6,657,560 B1 * 12/2003 Jung ..... 341/22
D487,263 S * 3/2004 Wang et al. ..... D14/247
D493,449 S * 7/2004 Wang et al. ..... D14/247
D496,004 S * 9/2004 Borsboom ..... D13/168
D496,005 S * 9/2004 Wang ..... D13/168
D497,882 S * 11/2004 Huang ..... D13/168
D500,028 S * 12/2004 Hoehn et al. ..... D14/218
D509,200 S * 9/2005 Harris ..... D14/138 R
D516,073 S * 2/2006 Boswell et al. ..... D14/399
D518,030 S * 3/2006 Lin ..... D14/218
D518,819 S * 4/2006 Gray ..... D14/230
7,059,790 B2 * 6/2006 Risheq ..... 400/491
D526,973 S * 8/2006 Gates et al. ..... D13/184
7,091,430 B1 * 8/2006 Haizima et al. ..... 200/6 A
7,113,111 B2 * 9/2006 Tyneski et al. ..... 341/20
D529,448 S * 10/2006 de Melo et al. ..... D13/168
D533,513 S * 12/2006 Marchetto et al. ..... D13/168
7,214,119 B2 * 5/2007 Lucas et al. ..... 446/465
7,218,249 B2 * 5/2007 Chadha ..... 341/23
D554,074 S * 10/2007 Laurent et al. ..... D13/164
7,290,344 B2 * 11/2007 Brandl et al. ..... 33/1 PT
7,298,311 B2 * 11/2007 Horie et al. ..... 341/176
D563,906 S * 3/2008 Cheng ..... D13/168
7,341,007 B2 * 3/2008 Vatsky ..... 110/104 B
7,463,312 B2 * 12/2008 Sata et al. ..... 348/734
D589,496 S * 3/2009 Legrand ..... D14/218
D597,514 S * 8/2009 Gencarella et al. .... D14/138 AC
D598,003 S * 8/2009 Park ..... D14/149
D601,564 S * 10/2009 Maeno ..... D14/400
D601,565 S * 10/2009 Maeno ..... D14/400
D602,915 S * 10/2009 Song et al. ..... D14/218
7,607,778 B2 * 10/2009 Oda ..... 351/240
D607,852 S * 1/2010 Riede ..... D13/174
D617,847 S * 6/2010 Royer et al. ..... D21/333
D619,121 S * 7/2010 Feldstein et al. ..... D14/218
D643,412 S * 8/2011 Brady et al. ..... D14/218
2002/0149566 A1 * 10/2002 Sarkissian ..... 345/168
2003/0122698 A1 * 7/2003 Horie et al. ..... 341/176
2003/0225542 A1 * 12/2003 Liu et al. ..... 702/132
2004/0066186 A1 * 4/2004 Sudo et al. ..... 324/207.21
2005/0068307 A1 * 3/2005 Flora et al. ..... 345/169
2005/0287920 A1 * 12/2005 Lucas et al. ..... 446/454
2006/0017857 A1 * 1/2006 Sata et al. ..... 348/734
2006/0150120 A1 * 7/2006 Dresti et al. ..... 715/810
2006/0294273 A1 * 12/2006 Lee ..... 710/67
2007/0046628 A1 * 3/2007 Lee et al. ..... 345/156
2007/0080940 A1 * 4/2007 Aoki et al. ..... 345/158
2007/0257946 A1 * 11/2007 Miller et al. ..... 345/694
2007/0291013 A1 * 12/2007 Won ..... 345/173
2008/0061194 A1 * 3/2008 Edwards ..... 248/121
2008/0074281 A1 * 3/2008 Okimura ..... 340/825
2008/0079604 A1 * 4/2008 Madonna et al. ..... 340/825.72
2008/0168501 A1 * 7/2008 Migos et al. ..... 725/46
2008/0172695 A1 * 7/2008 Migos et al. ..... 725/45
2008/0259024 A1 * 10/2008 Nam et al. ..... 345/156
2009/0121905 A1 * 5/2009 Griffin et al. ..... 341/35
2009/0154805 A1 * 6/2009 Cok et al. ..... 382/167
2009/0217207 A1 * 8/2009 Kagermeier et al. ..... 715/850
2009/0241052 A1 * 9/2009 Ha et al. ..... 715/772
2010/0053464 A1 * 3/2010 Otsuka ..... 348/734

FOREIGN PATENT DOCUMENTS

EP 1063129 A2 * 12/2000
EP 2253939 A2 * 11/2010
JP 51093075 A * 6/1996
JP 09046779 A * 2/1997
JP 2002089956 A * 3/2002
JP 2002238185 A * 8/2002
JP 2002243407 A * 8/2002
JP 2005-159639 A 6/2005
JP 2007-036508 A 2/2007
WO WO 9314943 A1 * 8/1993

* cited by examiner

REMOTE CONTROL TRANSMITTING DEVICE

CROSS-REFERENCE TO PRIOR RELATED APPLICATION

This application claims priority under 35 U.S.C. §119 to Japanese Patent Application No. 2008-224126 filed Sep. 1, 2008. The contents of that application, in their entirety, are incorporated by reference herein.

FIELD OF THE INVENTION

The present invention relates to a remote control transmitting device for performing control by transmitting control data to a controlled device, and, more specifically, relates to a remote control transmitting device which controls the controlled device using control data in accordance with rotating operations.

BACKGROUND OF THE INVENTION

Conventionally, there are known remote control transmitting devices, as remote-control transmitting devices for remotely controlling a video player device such as a DVD recorder, whereon a so-called "jog dial" annular dial key is attached to a case rotatably, and frame-by-frame or variable speed playback control of images recorded on the DVD recorder is performed in accordance with rotational operations of the dial key. (See, Japanese Unexamined Patent Application Publication 2007-36508, page 3, lines 36 through 50, page 4, lines 26 through 32, FIG. 1, and FIG. 3 ("JP '508"))

In this type of remote control transmitting device, the control content (for example, power supply ON and OFF, Fast-Forward, Rewind, Play, etc.) is displayed on a displaying unit, such as a liquid crystal panel, and after selecting a control content using a Send key that is attached to the case separately from the dial key, then, if, for example, "Play" were selected, then control data in accordance with the angle of rotation by the rotational operation of the dial key is sent to the DVD recorder, to perform the frame-by-frame playback control of the recorded video.

Additionally, there is a known remote control transmitting device in which a liquid crystal panel and dial key are disposed to rise and set freely from the side of a case. (See, Japanese Unexamined Patent Application Publication 2005-159639, Abstract, FIG. 5 ("JP '639")) When selecting a specific controlled device, for example, selecting the specific controlled device from a plurality of controlled devices, the liquid crystal panel and dial key are risen, the dial key is operated rotationally to move a cursor to a specific controlled device to be controlled which is selected from a plurality of the controlled device displayed on the liquid crystal panel, and an input operation is applied to a decision key attached to the case to select the controlled device displayed at the cursor.

However, because a displaying unit for displaying a plurality of control content and a dial key are attached to a case in a rectangular shape separately on the upper side and lower side respectively, the remote-control transmitting device as set forth in JP '508 has its limits to be miniaturized. In case it is miniaturized so as to prevent the display unit and dial key from overlapping, dimensions of the dial key need to be smaller, and thus it becomes difficult to rotate the dial key in a fine angle of rotation of the dial key, causing the controlled device not to be controlled with fine rotational operation.

The remote control transmitting device as set forth in JP '639, in which a liquid crystal panel and dial key are disposed to rise and set freely from the side of a case, because the dial key is housed in a case, when not used, at least the dimensions become smaller than the case, consequently, in case the case is miniaturized, the controlled device cannot be controlled corresponding to fine rotational operation of the dial key.

Further, because the dial key is located apart from the displaying unit in either of remote-control transmitting devices, there is no relation between the rotational operation direction or rotational operation angle of the dial key and control content displayed on the displaying unit, and thus, the control content is not displayed correlating with rotational operation direction or angle of the dial key, causing the operator a sense of confusion when guiding the operations of the dial key.

The present invention is the result of contemplation on the conventional problem areas of this type, and the object thereof is to provide a remote control transmitting device that, regardless of the case size, performs fine rotational operation of a dial key and control finely the controlled device corresponding to fine rotating angle of the dial key.

An additional object is to provide a remote control transmitting device enabling rotational operation by checking rotational control operation on a displaying unit without a sense of unease and by matching the rotational direction or rotational angle of rotational operation of dial key to the rotational direction or rotational angle of the controlled device controlled by the rotational operation displayed on the displaying unit.

SUMMARY OF THE INVENTION

In order to achieve the aforementioned objects, the remote control transmitting device as set forth above includes a case; an operation unit attached rotatably to the case; rotation detecting means for detecting the direction of rotation of the operating unit around a rotation center axis; a displaying unit for displaying a plurality of control content that controls controlled devices; operating signal generating means for generating control data for controlling the controlled device using selected control content, from the direction of rotation detected by the rotation detecting means; and transmission means for transmitting control data to controlled devices; wherein: the operation unit is attached to the case so as to cover entire outline of the case; and a displaying unit is attached to the case formed inside of the outline of the surface of the operation unit.

Because the operation unit has an outer shape that covers entire outline of a surface of the case, in case the entire size of the remote-control transmitting device is miniaturized, the operation unit can have a proper size for minute rotational operation.

Because the displaying unit is attached to the case formed inside of the outline of a surface of the operation unit, rotational operation can be performed while viewing the display on the displaying unit.

The remote-control transmitting device as set forth has: the outline of a surface of the case is formed in circle; the operation unit is guided rotatably by the guide unit formed along the circle outline of the case.

The operation unit is attached rotatably, without disposing a rotation axis that supports the operation unit at the center of rotation, by the guide unit that is formed along the circle outline of the case.

The remote-control transmitting device includes: an annular operating unit attached rotatably to the case; rotation detecting means for detecting the angle of rotation of the annular operating unit around a rotation center axis; a displaying unit for displaying a plurality of control content that controls controlled devices; an inputting switch, connected to the case, for selecting, by an inputting operation, specific control content from a plurality of control content that is displayed on the displaying unit; operating signal generating means for generating control data for controlling the controlled device using selected control content, from the angle of rotation detected by the rotation detecting means, in a control mode wherein specific control content has been selected by an inputting operation of the inputting switch; transmission means for transmitting control data to controlled device; the annular operating unit attached to the case in so as to cover the entire outline of a surface of the case; the inputting switch and displaying unit attached to a surface of a case that is exposed to an opening at a side of the rotational center of the annular operation unit.

Because the inputting switch and displaying unit are attached to a surface of a case that is exposed to an opening at a side of the rotational center of the annular operation unit, allowing the annular operating unit to form outer shape covering entire outline of a surface of the case, in case the entire size of the remote-control transmitting device is miniaturized, the annular operation unit can have a proper size for fine rotational operations.

Because the displaying unit for displaying control content is attached to inside of an opening at the center side of the annular operating unit that performs rotational operation, rotational operations are performed while viewing the display on the displaying unit.

The remote control transmitting device includes: the case having a large diameter disc and small diameter disc unit that is disposed on the same center axis of the large diameter disc unit at the upper side of a surface of the large diameter disc portion; the annular operation unit attached rotatably in rotation of the annular operating unit around a rotation center axis, between a first ring guide unit that is formed downward along the outer peripheral edge of the small diameter disc unit and a second ring guide unit that is formed upward along the outer peripheral edge of the large diameter disc unit.

Because the annular operating unit is guided along the outer peripheral edge of the large diameter disc and small diameter disc, the annular operating unit can be attached to the case rotatably, without disposing a rotation axis that supports the annular operation unit at the center of rotation.

The remote-control transmitting device includes the case having two or more annular operation units each of which is attached separately and rotatably in rotation around the same rotation center axis, and, per each annular operating unit, a plurality of rotation angle detecting means for detecting the rotation angle of the annular operating unit around a rotation center axis; the entire outline of a surface of the case covered by an annular operation unit having the largest diameter among the plurality of the annular operating units; the inputting switch and displaying unit attached to a surface exposed to an opening at the center side of the annular operation unit having the smallest diameter.

Because a plurality of controlled devices and a plurality of movements for controlling the controlled devices are allocated to two or more annular operation units, by selecting an annular operating unit for rotational operation, a controlled device for controlling and control movement can be selected.

A remote control transmitting device has a luminescent displaying means installed to the annular operating units; the luminescent displaying means for producing luminescence in various colors by control content selected by inputting operation.

The control content selected by inputting operation can be confirmed by luminescent color at the annular operation unit.

A remote control transmitting device includes the rotation detecting means detect the direction and angle of rotation of the annular operating units around a rotation center axis; the operating signal generating means generate control data for operating the controlled device rotationally using selected control content, from the direction and angle of rotation detected by the rotation detecting means, in a control mode wherein control content to operate the controlled device rotationally has been selected.

The various control data are generated by inputting operation of the inputting switch and the rotational direction and rotational angle of the rotational operation of the annular operating unit.

A remote control transmitting device has a guide displaying means installed to annular operation means display a direction of rotational movement of the controlled device in a control mode in which control content to operate the controlled device rotationally has been selected; in the control mode, when annular operation units are operated to rotate in a direction of rotational movement displayed by the guide displaying means, the operating signal generating means generate control data for controlling the rotation of the controlled device in a rotating movement direction displayed by the guide displaying means using rotating direction and rotation angle detected by rotation angle detecting means.

When the annular operating unit is operated rotationally in accordance with a rotational direction of the annular operation unit which is displayed by the guide display means, in a control mode in which control content to operate the controlled device rotationally has been selected, the controlled device is controlled the rotation in a rotational operation direction displayed by the guide display means.

A remote control transmitting device has a transmitting means is an RF (radio frequency) transmitting module which transmits control data to the controlled device using RF signals.

The controlled device can be controlled by an operator without concerning the disposing direction of the controlled device. In case the annular operation unit covers around the transmitting means, the transmission of the control data is not blocked by the annular operating unit.

Given the invention as set forth, when the entire size of the remote control transmitting device is miniaturized, the operating region does not become smaller, making it possible to control the controlled device finely by performing rotational operation in fine rotational angle.

In the invention as set above, because the rotation axis is not disposed at the center of the operation unit, the displaying unit can be attached to the operation unit at the rotation center side without interfering with the rotation axis.

Further, in the invention as set forth, because the displaying unit is disposed at the center of the annular operating unit that performs rotational operation, the rotation direction or rotation angle of the annular operating unit is displayed at the displaying unit in accordance with the control content, and the rotational operation is guided by the display at the displaying unit thus avoiding operator confusion when guiding the rotational operation.

In the invention as set forth, because the rotation axis is not disposed at the center of the annular operation unit, the displaying unit and inputting switch can be attached to the annular operation unit in the opening at the center side of the annular operating unit without interfering with the rotation axis.

In the invention as set forth, two or more annular operation units can be allocated in accordance with a plurality of the operation that controls the controlled device. In case the controlled device is controlled by a higher speed operation, the rotational operation is performed at an annular operation unit of smaller diameter at the center side, and in case the controlled device is controlled by a lower speed operation, the rotational operation is performed at an annular operation unit of larger diameter at outside, making it possible to perform the rotational operation at the annular operation unit of most proper external diameter in accordance with the speed of a control operation.

In the invention as set forth, the control data generated by performing rotational operation at the annular operation unit can be confirmed by luminescence color at the annular operation unit.

In the invention as set forth, the controlled device can be controlled by each rotational direction and rotational angle of the annular operating unit for the rotational operations.

In the invention as set forth, because the rotational direction of the controlled device is displayed at the annular operating unit by performing the rotational operation, display of the rotational operation direction displayed at the guide display means and the rotational operation direction of the controlled device match each other, making the operator perform the operation to control the controlled device in accordance with the display by the guide display means without a sense of confusion.

In the invention as set forth, compared with transmission means that transmit control data by infrared signal, because the direction of transmission does not need to be directed to the controlled device, the outer shape of the remote control transmitting device can be formed at the annular operating unit of which a rotational direction is not specified to the direction of rotation around the center axis. Further, because transmission of control data using RF signal is not blocked by the annular operating unit, the annular operating unit can be disposed around the transmitting means.

DETAILED DESCRIPTION OF THE INVENTION

Figure 1:
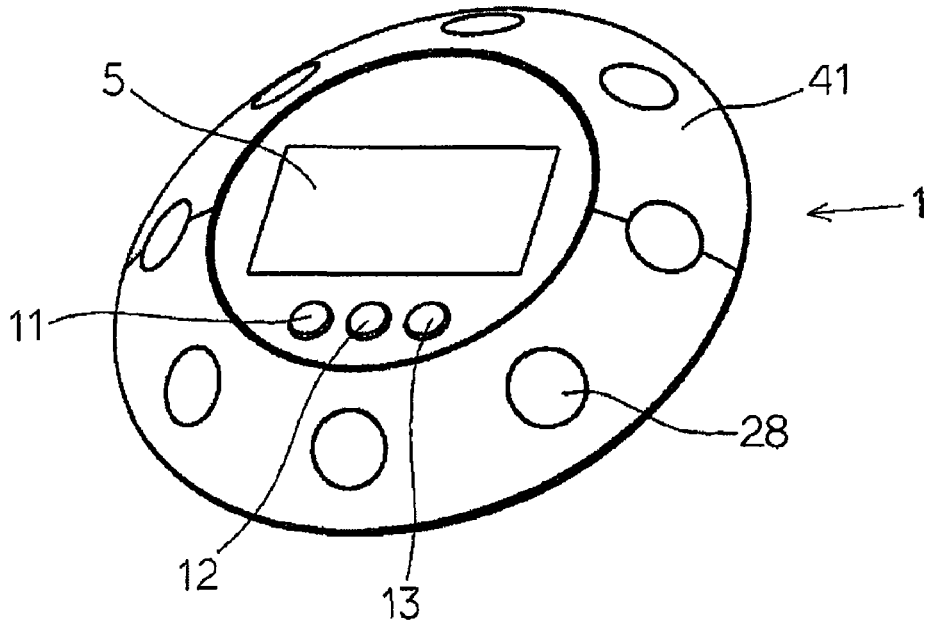
FIG. 1 is an oblique view of a remote control transmitting device as set forth in an example according to the present invention.
Figure 2:
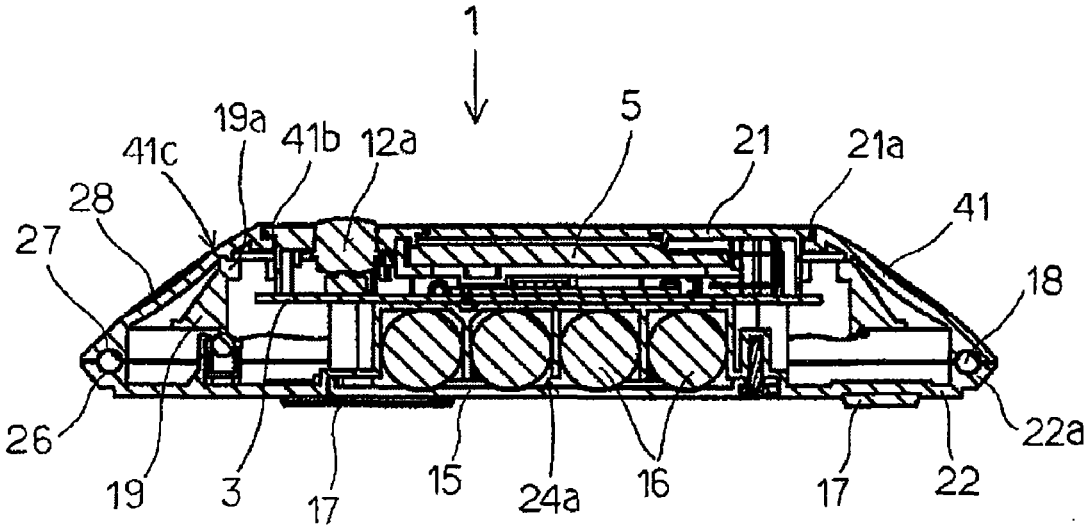
FIG. 2 is a lengthwise cross sectional diagram of the remote control transmitting device as set forth in FIG. 1.
Figure 3:
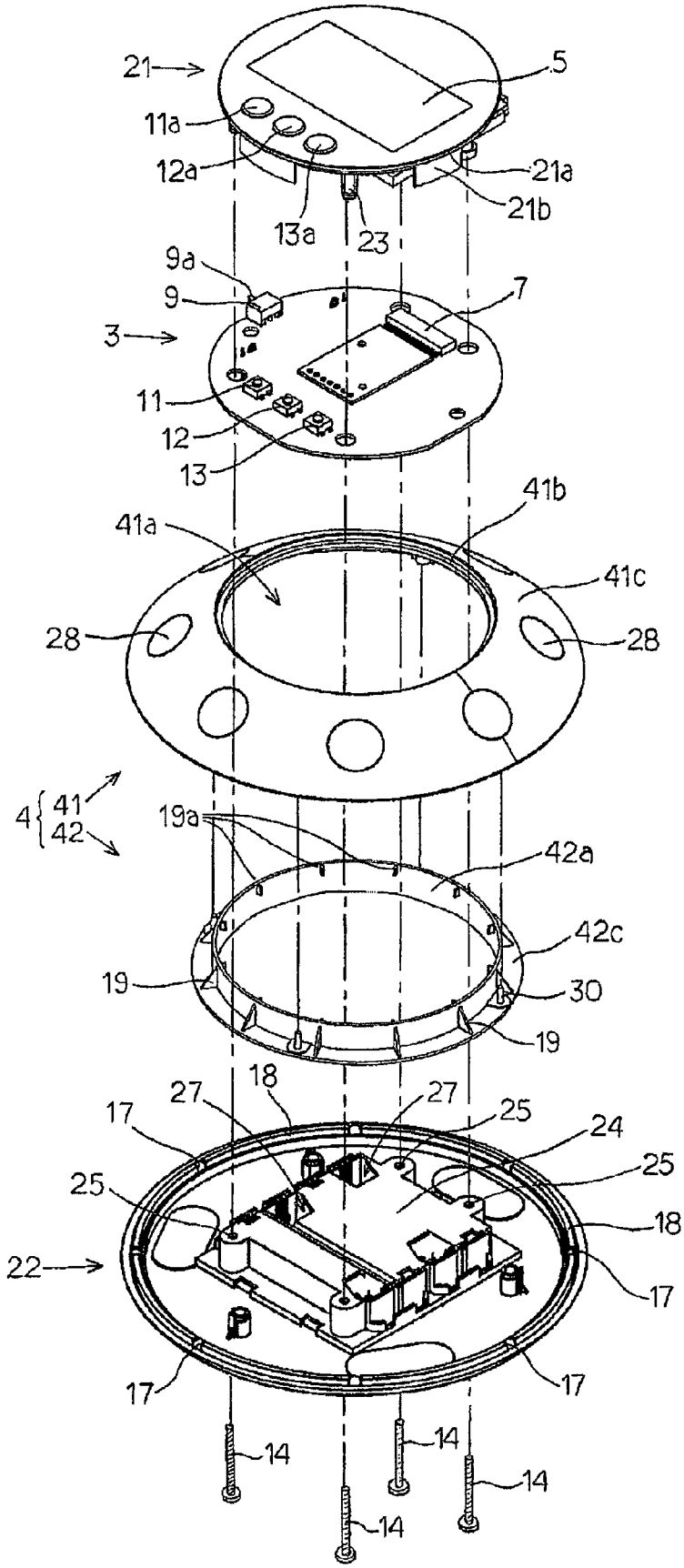
FIG. 3 is an assembly oblique expanded view, from above, of each part of the remote control transmitting device as set forth in FIG. 1.
Figure 4:
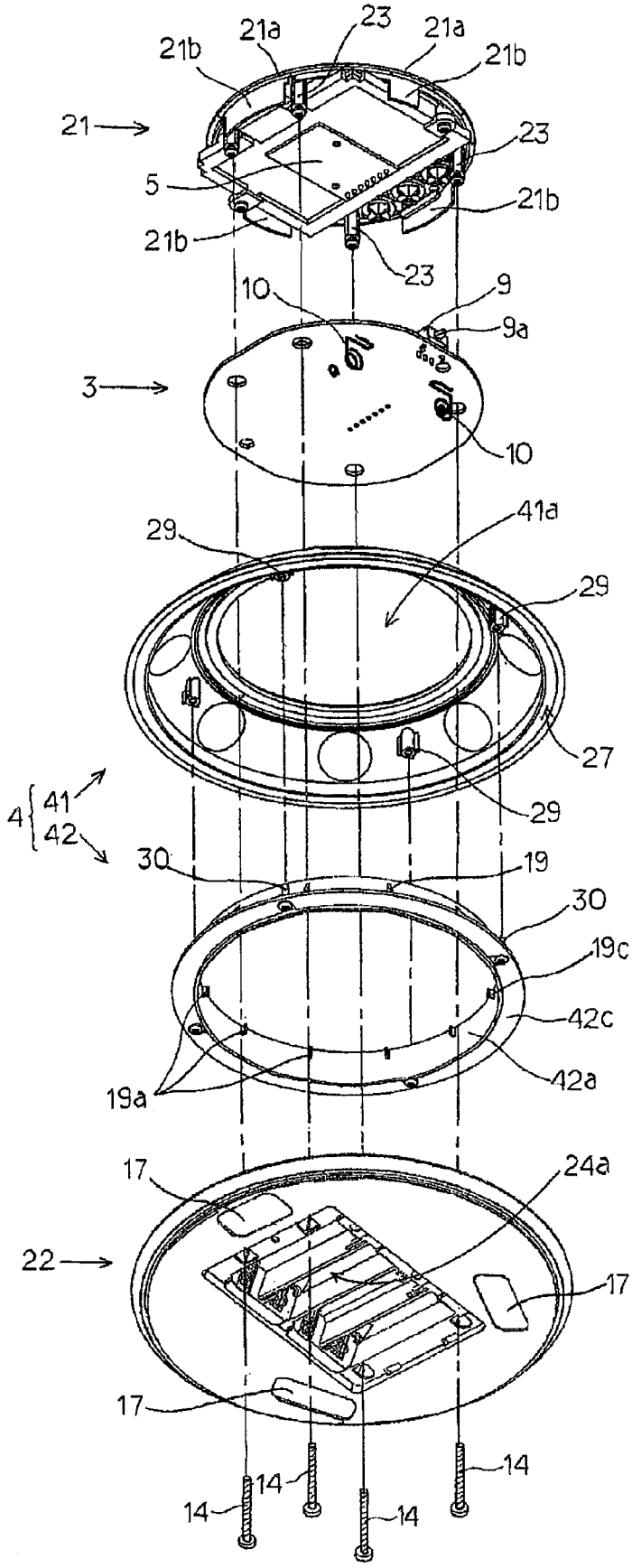
FIG. 4 is an assembly oblique expanded view, from below, of each part of the remote control transmitting device as set forth in FIG. 1.
Figure 5:
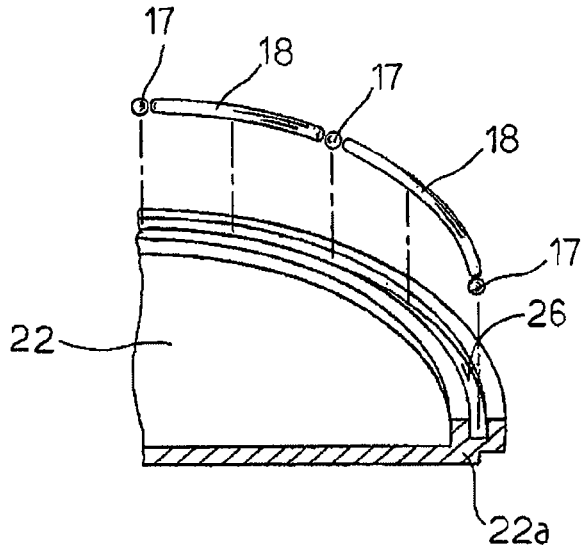
FIG. 5 is a magnified oblique view of substantial parts of a ring guide unit of a large-dimension disc portion.

A remote control transmitting device 1 as set forth according the present invention will be described below in reference to FIG. 1 through FIG. 6. FIG. 1 is an oblique view of a remote control transmitting device 1; FIG. 2 is a lengthwise cross-sectional diagram of the same; FIG. 3 is an assembly oblique view when seen from above the remote control transmitting device 1; FIG. 4 is an assembly oblique view when viewed from below; and FIG. 5 is a magnified oblique view of a substantial part of a ring guide unit of a large dimension disc portion.

As illustrated in FIG. 3 and FIG. 4, the remote control transmitting device 1 is provided with: an insulated case 2, structured from a small diameter disk portion 21 and a large diameter disk portion 22; a circular printed wiring board 3 that is attached interposed between the small diameter disk portion 21 and the large diameter disk portion 22; an annular operating unit 4 structured from a ring-shaped jog dial 41 and an operating ring 42; and three inputting switches 11, 12, and 13, on which operating buttons are formed, on the front surface side of the small diameter disk portion 21; and a liquid crystal display element 5.

The small diameter disk portion 21 is formed in a disk shape from synthetic plastic, and the liquid crystal display element 5 is attached from the bottom surface side (the bottom surface in FIG. 2), where the display screen of the liquid crystal display element 5 faces the inside of a rectangular opening that opens through to the front surface side. Moreover, the respective operating buttons 11*a*, 12*a*, and 13*a* of the three inputting switches 11, 12, and 13 are attached on the front surface side to rise and set freely, along one side of the rectangular shaped opening, so as to be attached at the positions of the inputting switches in 11, 12, and 13, which are each mounted on the printed wiring board, when the printed wiring board 3 is attached on the bottom surface side.

The outer peripheral edge portion 21*a* of the small diameter disk portion 21 has a circular outline, where guide pieces 21*b* that is a first ring guide portion, having circular arc shapes, are provided perpendicularly from four locations at 90° intervals along the outline of the outer peripheral edge portion 21*a*, slightly towards the center on the bottom surface side of the outer peripheral edge portion 21*a*. (See FIG. 4.) In a cylindrical inside surface of the inner peripheral edge that is formed by a center opening 41*a* of a jog dial 41, the inner diameter of the inside surface on the top side is slightly longer than the outer diameter of the outer peripheral edge portion 21*a* of the small diameter disk portion 21, by a round step portion 41*b*, and the inner diameter of the inside surface on the bottom side is smaller than the outer diameter of the outer peripheral edge portion 21*a* and slightly larger than the diameter of the circle that is formed by the four guide pieces 21*b*. This causes the jog dial 41, which is assembled from above the center opening 41*a*, to contact the outer peripheral edge portion 21*a*, on the step portion 41*b*, to control the movement upward relative to the small diameter disk portion 21, and the inside surface on the top side and the inside surface on the bottom side slides along the outer peripheral edge portion 21*a* of the small diameter disk portion 21 and the guide pieces 21*b*, respectively, to be guided so as to be able to rotate.

On the bottom surface of the small diameter disk portion 21, screw receptacle protrusions 23, wherein screw threads have been provided on the cylindrical inner surfaces thereof, are provided perpendicularly in another four locations in order to screw screws 14, which pass through the printed wiring board 3 and the large diameter disk portion 22, to the screw receptacle protrusions 23. The outer diameter of these screw receptacle protrusions 23 is greater than the inner diameter of through holes 31 that are provided in four locations in the printed wiring board 3, and thus the gap between the bottom surface of the small diameter disk portion 21, which is secured through screwing, and the printed wiring board 3 is at a height that is equal to that of the screw receptacle protrusions 23, where that height is higher than the height of each of the circuit components that are mounted on the printed wiring board 3, where the inputting switches 11, 12, and 13 are at a height so as to make contact with the bottom surface of each of the operating buttons 11*a*, 12*a*, and 13*a* when not pushed.

Figure 6:
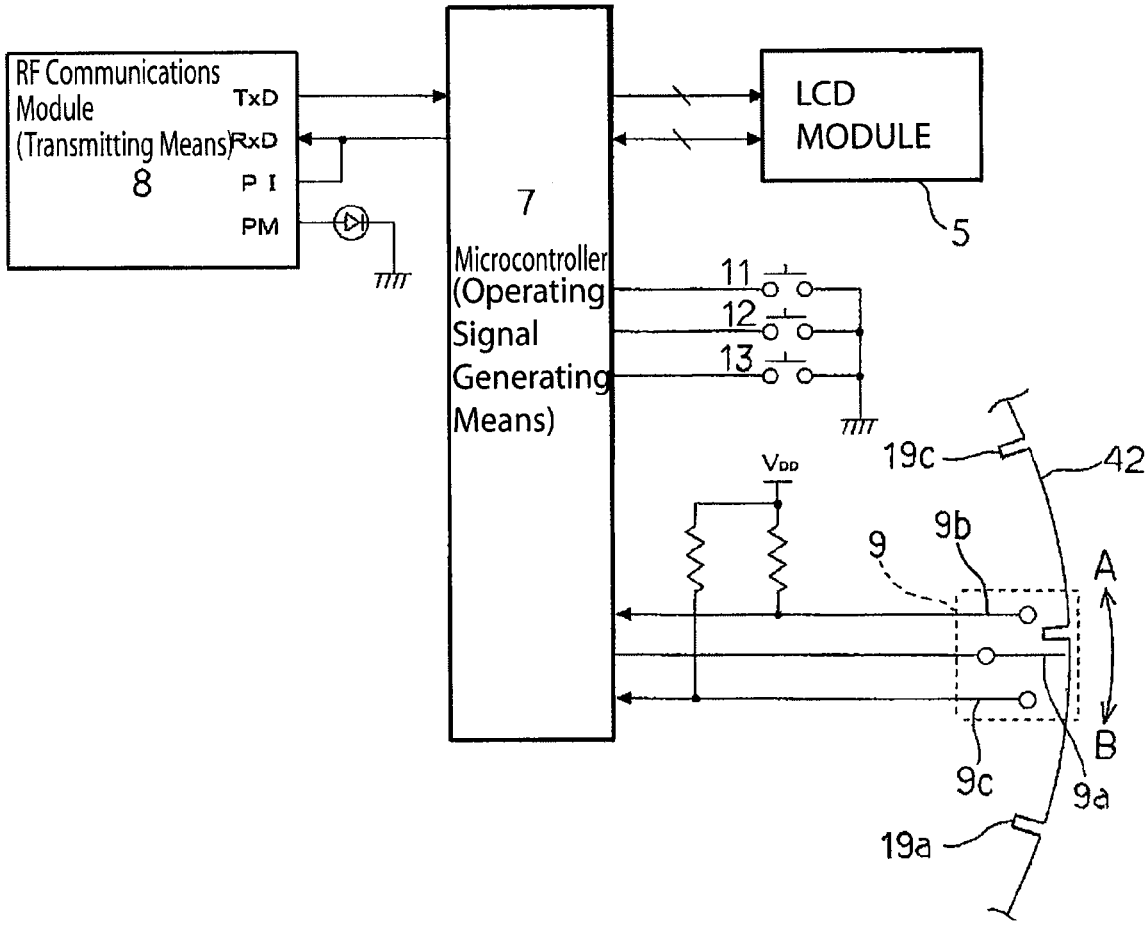
FIG. 6 is a block diagram illustrating the circuit structure of the remote control transmitting device as set forth in FIG. 1.

Along with the aforementioned inputting switches 11, 12, and 13, a microcontroller 7 as illustrated in FIG. 6, which works also a driver for the liquid crystal display element 5, RF communications module 8, and lever-type detecting switch 9 are mounted together with the drivers for the on the front surface of the printed wiring board 3. The lever-type detecting switch 9 is mounted on the periphery of the printed wiring board 3 so that a movable terminal 9*a*, which moves in a circular path on the printed wiring board 3, protrudes to the outside, in the radial direction, from the edge of the printed wiring board 3. Additionally, on the bottom surface of the printed wiring board 3 is attached a pair of wire contacts 10 that connect to one edge of a power supply pattern on the front surface side.

Figure 9:
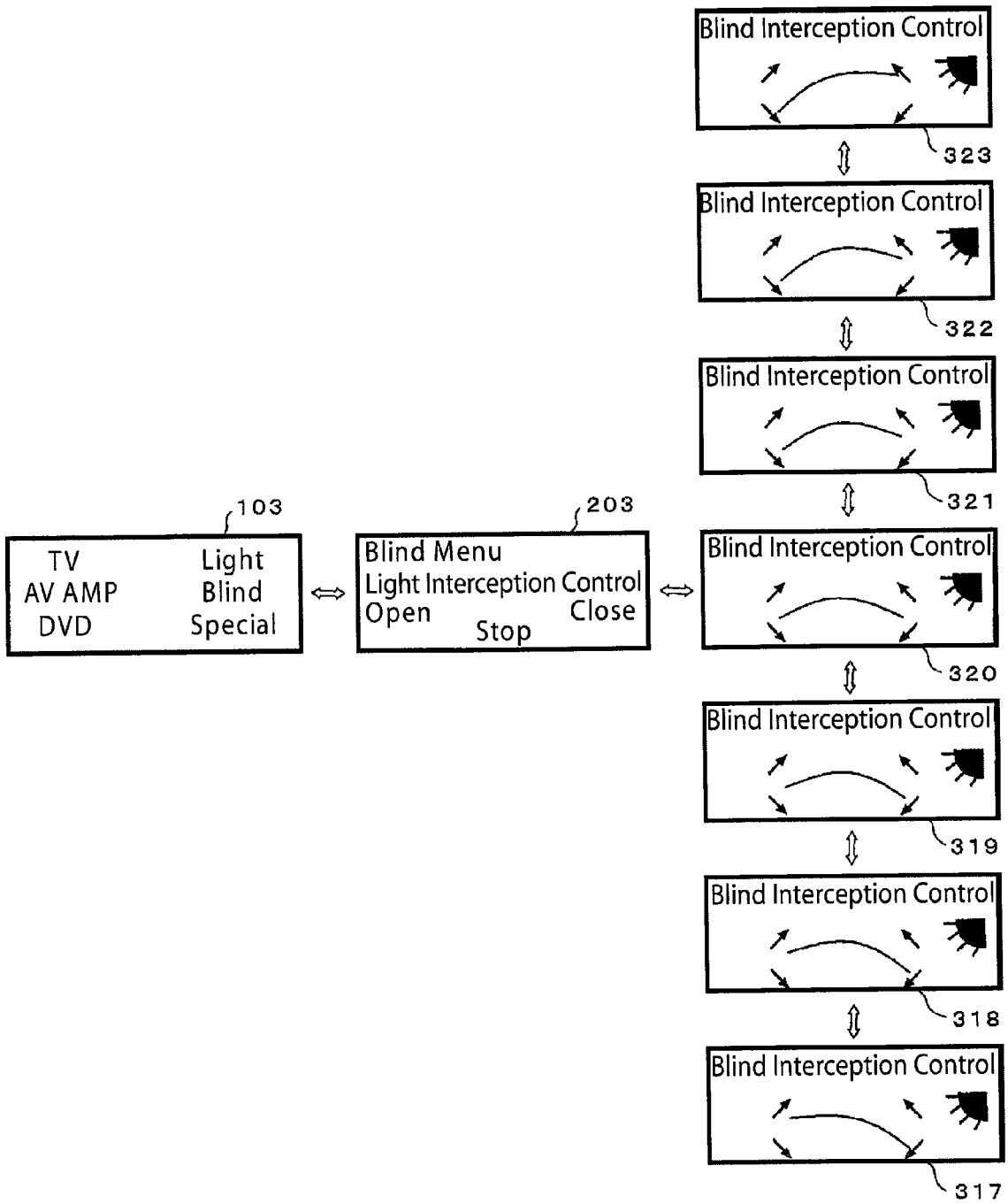
FIG. 9 is an explanatory diagram illustrating a display that is displayed on a liquid crystal display element when controlling the closing of blinds.

The large diameter disk portion 22 is formed from synthetic plastic into a disk shape having a diameter that is larger than the outer diameter of the small diameter disk portion 21, and is provided with a bottom guide groove 26, which is semicircular in its cross section, on the front surface of the outer peripheral edge portion 22*a*, along the circular outer periphery thereof. As illustrated in FIG. 3 and FIG. 9, this bottom guide groove 26 accommodates eight balls 17 that move within the bottom guide groove 26, and circular arc-shaped spacers 18 that maintain the gaps between the balls 17. The spacers 18 are formed as long and thin linear shapes from a flexible material, such as silicone, which has little friction with the synthetic plastic from which the large diameter disk portion 22 is formed, and thus by housing the spacers 18 along the ring-shaped bottom guide groove 26, the spacers 18 are formed into circular arc shapes conforming to the bottom guide groove 26. The bottom guide groove 26 and the balls 17 of the outer peripheral edge portion 22*a* comprise a second ring guide portion that guides the jog dial 41 so as to be able to rotate freely around the center axis thereof.

A box-shaped battery housing portion 24 is formed integrally with the center of the front surface side of the large diameter disk portion 22. Battery housing indentation portions 24*a* within the battery housing portion 24 are open on the bottom surface side, and house four batteries 16 (shown in FIG. 2) from the bottom surface side. Contact through holes 27 allow the tips of a pair of wire contacts 10 to face into the battery housing indented portion 24*a* when the printed wiring board 3 is layered onto the front surface side of the large diameter disk portion 22. They are provided standing from two different locations of the battery housing portion 24, to connect to the positive terminal and the negative terminal of the batteries 16 housed in the battery housing indented portions 24*a*. The direct current power supply of the four batteries 16, which are connected in series within the battery housing indentation portion 24*a*, is supplied to each of the circuit components mounted on the printed wiring board 3, through the contacts 10 and the power supply pattern of the printed wiring board 3.

Additionally, through holes 25, through which the four screws 14 pass, are provided in four locations on the periphery of the battery housing portion 24 so as to extend to the bottom surface of the large diameter disk portion 22. The openings on the bottom surface side of the through holes 25 and the openings for the battery housing indented portion 24*a* are covered with the battery cover 15 (shown in FIG. 2) that is screwed to the bottom surface side.

The remote control transmitting device 1 is used while placed on a table, or the like, and so non-skid pads 17 are adhered in three locations, at 120° intervals, on the bottom surface side of the large diameter disk portion 22, so that the remote control transmitting device 1 will not move at the time of an inputting operation.

The jog dial 41 is formed into a truncated circular cone shaped wherein a circular center opening 41*a* is open at the peak portion of a shallow dish shape, where the ring-shaped rotational operating surface 41*c* formed between the small diameter inner peripheral edge that is the outline of the center opening 41*a* and the large diameter outer peripheral edge slants downwards towards the outside from the center. As described above, the inside surface of the inner peripheral edge side, which faces the center opening 41*a*, has an inner diameter of the inside surface on the top side that is larger than the inner diameter of the inside surface on the bottom side by a step portion 41*b*, and thus by fitting to the outer peripheral edge portion 21*a* of the small diameter disk portion 21 and the guide pieces 21*b*, the jog dial 41 is prevented from coming out in the upper direction of the small diameter disk portion 21, and guided so as to be able to rotate freely around the center axis of the small diameter disk portion 21.

The outer diameter of the jog dial 41 is essentially equal to the outer diameter of the large diameter disk portion 22, where a top guide groove 27, having a semicircular shape in the cross section thereof, symmetrical to the bottom guide groove 26 of the large diameter disk portion 22, is formed in the shape of a circle along the outer peripheral edge at the bottom surface of the outer peripheral edge portion thereof. Given this structure, when the jog dial 41 is placed on the large diameter disk portion 22, so as to be coaxial therewith, the top guide groove 27 and the bottom guide groove 26 face each other with the balls 17 and the spacers 18 housed so as to be able to roll or slide freely between the top guide groove 27 and the bottom guide groove 26, so that the jog dial 41 is guided so as to be able to rotate freely around the center axis of the large diameter disk portion 22.

On the front surface of the rotational operating surface 41*c*, non-slip indentation portions 28, which are shaped so as to prevent slipping of the rotational operation, are provided at essentially equal intervals around the center axis, and, on the bottom surface thereof, positioning cylindrical portions 29 are provided integrally at 90° angles around the center axis, extending perpendicularly.

The operating ring 42 is formed from a cylindrical portion 42*a* with an inner diameter that is slightly larger than the outer diameter of the printed wiring board 3, and a flange portion 42*c* that protrudes in the horizontal direction towards the outside from the bottom surface of the cylindrical portion 42*a*. A plurality of bracket pieces 19 are secured at essentially equal intervals around the center axis between the cylindrical portion 42*a* and the flange portion 42*c*, and the tip portions of each bracket piece 19 are operating protrusions 19*a* that pass through the cylindrical portions 42*a*.

Positioning protrusions 30, which set into the positioning cylinder portions 29, are provided standing on the front surface of the flange portion 42*c* of the operating ring 42, facing the positioning cylindrical portions 29 of the jog dial 41, so that after the positioning protrusions 30 and the positioning cylindrical portions 29 are fitted together, the two are secured using an adhesive, with the operating ring 42 secured to the bottom surface side of the rotational operating surface 41*c* of the jog dial 41.

The assembly of the remote control transmitting device 1, set forth above, is combined into a single unit by screwing four screws 14 from the bottom surface side of the large diameter disk portion 22 through the large diameter disk portion 22 through holes 25 and the printed wiring board 3 through holes 31, into the screw receptacle protrusions 23 of the small diameter disk portion 21, as shown in FIG. 2 and FIG. 3, with the jog dial 41, with the operating ring 42 secured on the bottom surface thereof, between the small diameter disk portion 21 and the large diameter disk portion 22.

In the state wherein the assembly has been screwed together, in sequence from the top, the small diameter disk portion 21, the jog dial 41, the operating ring 42, the printed wiring board 3, and the large diameter disk portion 22 are disposed on top of each other so as to rotate coaxially, and as illustrated in FIG. 2, the jog dial 41 is guided, by the first ring guide portion of the small diameter disk portion 21 and the second ring guide portion of the large diameter disk portion 22, so as to be able to rotate freely around the center axis.

Additionally, a cylindrical portion 42*a* of the operating ring 42 is disposed so as to be able to rotate freely around the periphery of the lever-type detecting switch 9 that is mounted on the printed wiring board 3, so that the movable terminal 9*a* of the lever-type detecting switch 9 is disposed on the same periphery as the operating protrusion 19*a* that protrudes to within the cylindrical portion 42*a*, and, as described above, the respective individual operating buttons 11*a*, 12*a*, and 13*a* of the inputting switches 11, 12 and 13, make contact with the actuators of the inputting switches 11, 12, and 13 that are mounted on the printed wiring board 3.

FIG. 6 is a block diagram illustrating the circuit components for structuring the remote control transmitting device 1, wherein the lever-type switch 9, the inputting switches 11, 12, and 13, the liquid crystal display element 5, and the RF communications module 8 are connected to the microcontroller 7.

The lever-type detecting switch 9 is a rotation detecting element for detecting a rotational direction and a rotational angle due to a rotational operation on the jog dial 41, where, when there is a rotational operation of the jog of 41 in one direction (for example, the direction A in FIG. 6), the operating protrusions 19*a* that move in that direction of rotation strike the movable terminal 9*a* of the lever-type detecting switch 9, causing the movable terminal 9*a* to contact the stationary terminal 9*b* in that direction of rotation, causing a pulse signal due to the contact between the movable terminal 9*a* and the stationary terminal 9*b*. On the other hand, when the jog dial 41 is operated rotationally in the opposite direction (for example, direction B in FIG. 6), then, similarly, the movable terminal 9*a* and the stationary terminal 9*c* will make contact in that direction of rotation, producing a pulse signal due to the contact between the movable terminal 9*a* and the stationary terminal 9*c*. If a pulse signal that is inputted from the lever-type detecting switch 9 is inputted from between the movable terminal 9*a* and the stationary terminal 9*b*, then the microcontroller 7 determines that there is a rotational operation in the A direction, but if inputted from between the movable terminal 9*a* and the stationary terminal 9*c*, then the microcontroller 7 determines that there has been a rotational operation in the direction B. Additionally, because the operating protrusions 19*a* are provided at equal angle intervals around the center of the jog dial 41, the angle of rotation of the jog dial 41 can be determined by the number of occurrences of the inputted pulse signals, and the speed of rotation thereof can be determined by the frequency of occurrences of the pulse signals within a specific unit time period.

Note that the movable terminal 9*a* has elasticity to recover to the center position, so that when the operating protrusions 19*a* cause the movable terminal 9*a* to make contact with either of the stationary terminals 9*b* or 9*c*, against the elastic force that is received from the movable terminal 9*a*, and the operating protrusions 19*a* go past the movable terminal 9*a*, then the elastic force that is received from the movable terminal 9*a* is released, so that the operator receives the feel of a click each time an operating protrusion 19*a* passes by the movable terminal 9*a*, making it possible to obtain a feel of the rotational operation, including the amount of rotation of (the rotational operation angle).

The microcontroller 7, upon an input of a pulse signal indicating a rotational operation of the lever-type detecting switch 9 and an operating signal from an inputting switch 11, 12, and 13, controls the specific display of the liquid crystal display element 5, in accordance with the input, and controls the communications operation of the RF communications module 8. When an operating signal is inputted from the inputting switch 11, at this time the controlled device, control operation for a controlled device, or other control content indicated by cursor on the control display device 5 is selected, and when an operating signal from the inputting switch 12 is inputted, then radio communications are performed between the controlled device that is to be controlled and the RF communications module 8, and the operating status thereof is displayed on the liquid crystal display element 5, and when an operating signal from the inputting switch 13 is inputted, then the control content that indicates the controlled device or the content of the control operation for the controlled device, selected by the inputting switch 11, is canceled. Additionally, when the cursor that is displayed on the liquid crystal display element 5 is moved and control operation for controlling the controlled device is selected by the inputting switch 11, by the pulse signals from the lever-type detecting switch 9, control data for controlling the controlled device is generated in accordance with the pulse signal count, and outputted to the RF communications module 8.

The RF communications module 8 is connected to the microcontroller 7 through asynchronous bidirectional indications based on UART (Universal Asynchronous Receiver Transmitter). Furthermore, the RF communications module 8 performs radio communications with the controlled device, specified in advance through pairing, using a standard based on the Radio Communications Standard IEEE 802.15.4, and when a command is received from the microcontroller 7, the operating status of the controlled device is received, and when control data for controlling the operation of the controlled device is received from the microcontroller 7, then the control data is sent to the controlled device through radio communications, to cause the execution of operations in accordance with the control data.

The operation of the remote control transmitting device 1, structured as set forth above, will be described below using FIG. 7 through FIG. 9. When in a standby state wherein the remote control transmitting device 1 is not used, the microcontroller 7 operates in a sleep mode that only detects inputs from the inputting switches 11, 12, 13, and the lever-type detecting switch 9, in order to minimize wear on the batteries 16.

Figure 7:
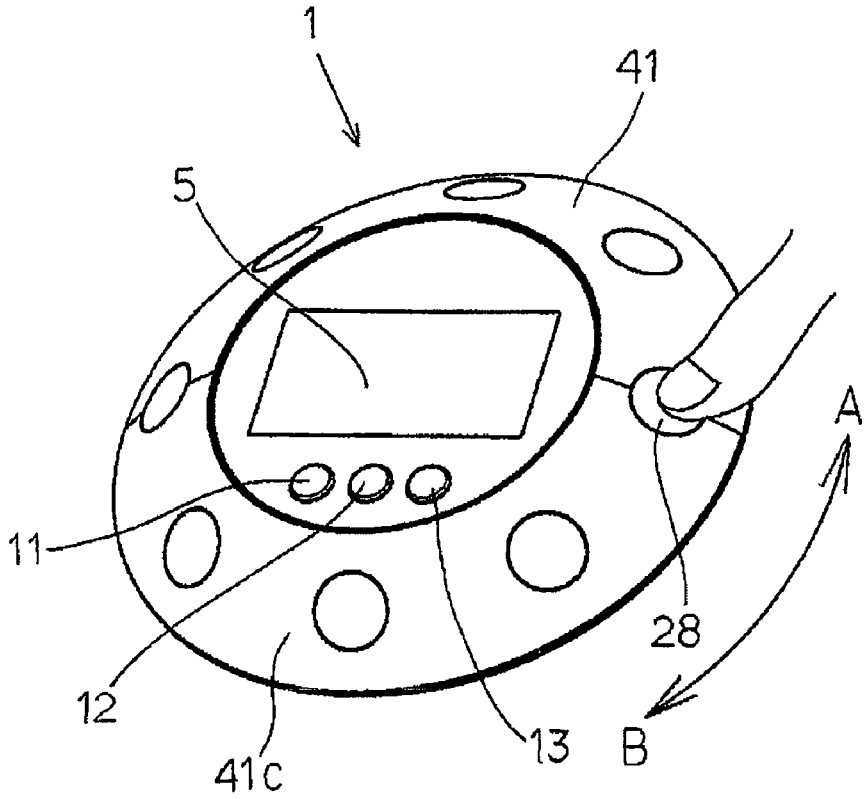
FIG. 7 is an oblique view illustrating the state of the use of the remote control transmitting device as set forth in FIG. 1.
Figure 8:
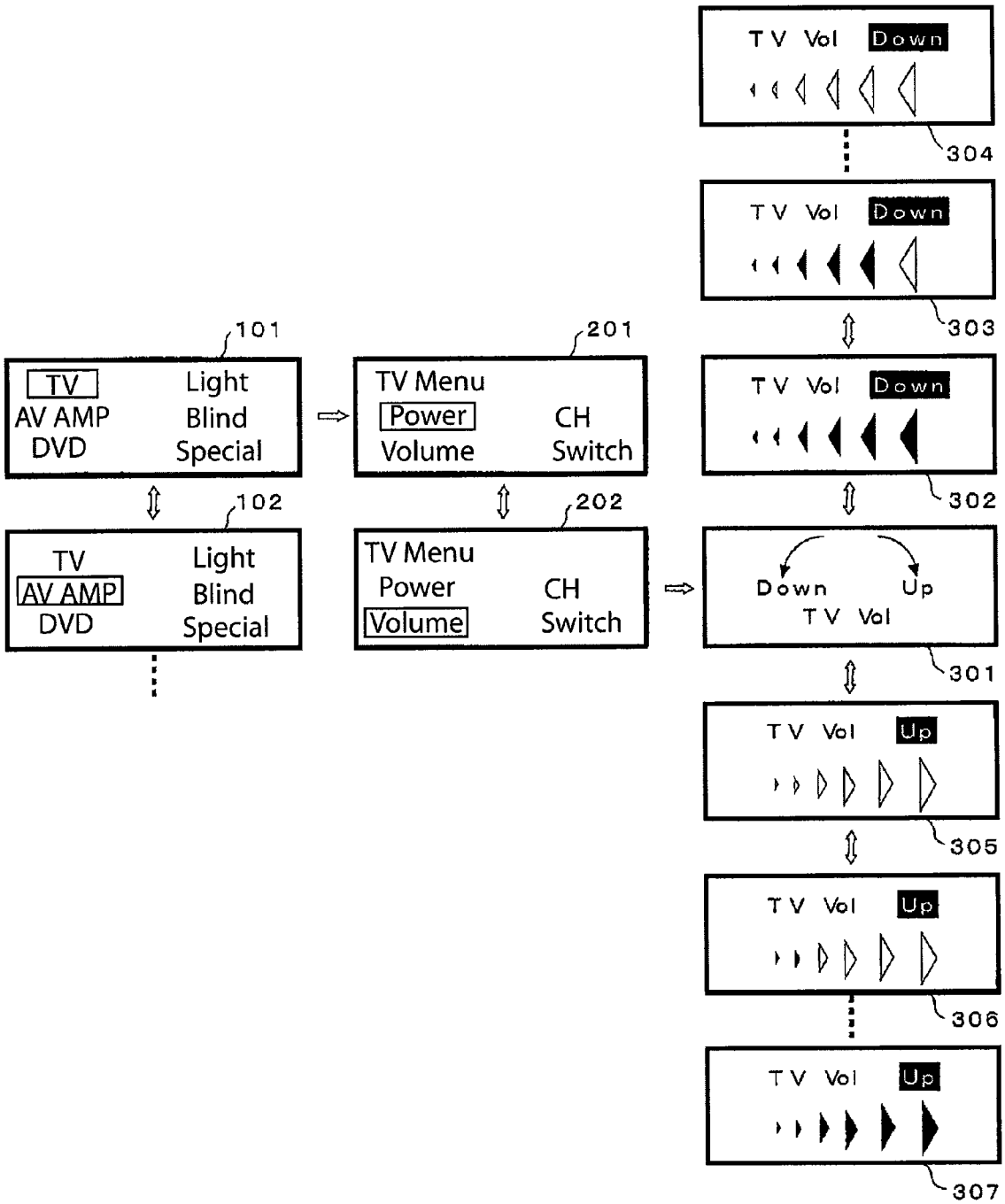
FIG. 8 is an explanatory diagram illustrating a display that is displayed on a liquid crystal display element when adjusting the television audio volume.

In the initial state wherein an input has been detected from any of the inputting switches 11, 12, or 13, or from the lever-type detecting switch 9, the liquid crystal display element 5 displays the main menu illustrated by 101 in FIG. 8, and displays the cursor 31 that is shown in reverse video in the display position of the television, which is one of the controlled devices. The main menu is the inputting mode for selecting the controlled device to be controlled, and as illustrated in FIG. 7, in selecting the controlled device, the cursor 31 that is displayed on the liquid crystal display element 5 is moved by rotating the jog dial 41 around the center axis thereof by pressing on the non-slip indentation portion 28 with a finger.

The cursor 31 moves on the display screen of the liquid crystal display element 5 so as to match the direction of rotation of the jog dial 41, and when, for example, the jog dial 41 is operated rotationally in the A direction in FIG. 7 (the counterclockwise direction), then a series of a plurality of pulse signals is inputted into the microcontroller 7 from between the movable terminal 9*a* and the stationary terminal 9*b*, and the microcontroller 7 detects the rotational operation in the A direction, and moves the cursor 31, which is at the display position of the television, to the display position of the AV amplifier, which is in the same direction as the A direction indicated by 102.

After the cursor 31 has been moved, through this type of rotational operation, to the display position of the controlled device to be controlled, then an inputting operation is performed by the inputting switch 11. Here a television sound volume operation will be performed, so when the cursor 31 is moved to the display position of the television in the main menu (101) and an inputting operation is performed by the inputting switch 11, then the display screen on the liquid crystal display element 5 is switched to the Television menu inputting mode (201). The cursor 31 is moved to match the direction of the rotational operation of the jog dial 41 in the same manner as in the main menu, and in order to operate the volume, the jog dial 41 is operated rotationally in the A direction, and when the cursor 31 is moved to the display position of the volume (202), an inputting operation is performed by the inputting switch 11. When this is done, the microcontroller 7 moves to a controlling mode wherein control content for controlling the television volume has been selected. Note that when the inputting switch 13 is inputted, in any display screen that displays the Television menu, the display screen returns to the main menu (101), one level back.

When the cursor 31 is at the display position of the volume (202) and an inputting operation is performed by the inputting switch 11, then the display screen of the liquid crystal display 5 is switched to the inputting mode (301) for adjusting the volume. In the inputting mode (301) for adjusting volume, the control content for controlling the volume up or down, along with the rotational operation directions for the jog dial 41 in order to perform these controls, are shown by arrows by the liquid crystal display element 5, which is disposed on the center side of the jog dial 41. That is, the rotational operation directions of the jog dial 41 for producing the control data for this control content (volume up or volume down) are indicated by arrows around the same center axis on the center side of the jog dial 41, thus enabling the operator to perform the rotational operation without mistaking the rotational operation direction of the jog dial 41 for the control content. When the jog dial 41 is operated rotationally in the A direction, control data for reducing the sound volume of the television is sent to the television, and not only does the sound volume decrease in accordance with the rotational angle in the A direction, but also there is a switch to a display wherein the black triangle mark indicates that the volume has been reduced (302 through 304). Additionally, when the jog dial 41 is operated rotationally in the B direction, control is performed to increase the sound volume of the television, and not only does the sound volume increase in accordance with the rotational angle in the B direction, but also the black triangle mark that indicates the sound volume moves to display the increase (305 through 307).

Next, when the closing of the blinds is to be controlled, then the a rotational operation is performed on the jog dial 41 in either the A direction or the B direction from the main menu illustrated by 101 in FIG. 8 to move the cursor 31 to the display position of the blinds in FIG. 9 (103), and an inputting operation is performed by the inputting switch 11. The display screen on the liquid crystal display element 5 switches to the inputting mode (203) for the Blind menu, and when the cursor 31 is moved to Adjust Closing in this inputting mode and an inputting operation is performed by the inputting switch 11, then the blind closing adjustment inputting mode (320), which shows the directions for opening and closing the blinds, is displayed. At the same time, the microcontroller 7 switches to a control mode wherein control content for controlling the blind opening adjustment has been selected.

In the blind closing adjustment inputting mode (320), the opening/closing status of the blinds, when seen from the side, is displayed in the liquid crystal display element 5, where the opening and closing directions match the directions of opening and closing through the rotational operation of the jog dial 41. That is, when there is a rotational operation in the counterclockwise direction (the A direction) on the jog dial 41, the blinds are rotationally controlled in the counterclockwise direction, when viewed from the right side, to narrow the gaps between the blinds, to increase the amount of light blocked, and when there is a rotational operation in the clockwise direction (the B direction), then the blinds are rotationally controlled in the clockwise direction, widening the gaps between the blinds, increasing the amount of light allowed.

The rotational control of the blinds is performed proportionately to the rotational angle of the jog dial 41, and when the jog dial 41 is operated rotationally in the A direction, the blinds are rotationally controlled to rotate to the left in accordance with the rotational angle thereof, and the display on the liquid crystal element 5 moves in a direction (the direction from 317 to 323 in FIG. 9) indicating that the blinds are gradually rotating to the left. Conversely, when there is a rotational operation in the B direction, rotational control is performed to rotate the blinds to the right in accordance with the rotational angle thereof, and the display on the liquid crystal display element 5 moves in a direction (the direction from 323 to 317 in FIG. 9) indicating that the blinds are gradually rotating to the right.

Because, in the example of the present invention, the jog dial 41 has a size that covers the entire shape of the front surface of the case 2 to be a large jog dial 41 with a large diameter and a plurality of operation protrusion 19*a* is attached at equal intervals around the center axis, fine angle rotational operations can be achieved easily making fine rotational control for the blind performed by detecting fine angle rotational operation of the jog dial 41 by microcontroller 7 and displaying the condition of the blind on the liquid crystal display element 5.

Although in each of the examples of embodiment set forth above, a type of the jog dial 41 is attached rotatably to the case 2, two or more types of jog dials each of which can detect the rotational direction may be attached rotatably around the same center axis and, in accordance with the control content and controlled unit, the rotational operations of two or more types of jog dials may be used separately as the situation demands. For example, when two types of jog dials are performed rotational operations at the same rotational angle, controlled units may be controlled by the two types of jog dials generating control data that control with different rotational angles for separated rotational operations to high speed control and fine adjustment control through the rotational operations.

Additionally, light-emitting displaying means, such as LEDs, may be attached to the rotational operating surface of the jog dial, and the light-emitting displaying means may be turned ON or OFF to indicate the specific control content that has been selected.

Further, guide displaying means formed from said light-emitting displaying means or another displaying means may be attached to the jog dial, so as to guide rotational operation direction of the jog dial by display displayed by the guide displaying means for controlling the controlled device by control content displayed on the liquid crystal display element.

Additionally, an operation unit for performing rotational operations may not always have to be formed in an annular shape such as a jog dial and may have an outer shape that covers entire surface of the case 2 without disposing an opening at the center axis side.

The present invention can be applied to remote control transmitting devices for controlling controlled devices through rotational operations of an annular operating unit.

We claim:

1. A remote control transmitting device comprising:

a case;

an annular operating unit rotatably attached to the case;

a rotation detecting device detecting an angle of rotation and a direction of rotation of the annular operating unit around a rotation center axis;

a displaying unit for displaying a plurality of control content that controls a controlled device;

an inputting switch, connected to the case, for selecting, by an inputting operation, specific control content from the plurality of control content that is displayed on the displaying unit;

an operating signal generating device generating control data for controlling the controlled device using selected control content, from the angle of rotation and the direction of rotation detected by the rotation detecting device, in a control mode, wherein the specific control content has been selected by an inputting operation of the inputting switch, wherein, in the control mode, the specific content operates the controlled device rotationally; and a transmission device transmitting control data to the controlled device;

a guide displaying device installed next to the annular operation unit, wherein the guide displaying device displays a direction of rotation of the controlled device in the control mode, wherein, in the control mode, when the annular operation unit is operated rotationally in the direction of rotation displayed by the guide displaying device, the control data controls the controlled device rotationally according to a rotational operation direction displayed by the guide displaying device using the angle of rotation and the direction of rotation detected by the rotation detecting device;

wherein the annular operating unit attached to the case so as to cover the entire outline of a surface of the case; and wherein the inputting switch and displaying unit attached to a surface of a case that is exposed to an opening at the rotational center side of the annular operation unit.

2. The remote control transmitting device as set forth in claim 1, wherein:

the case has a large diameter disc portion and a small diameter disc portion disposed on the same center line of the large-diameter disc unit at the upper side of the surface of the large diameter disc portion; and the annular operation unit is rotatably attached around a rotation center axis of the annular operating unit, between a first ring guide unit formed downward along the outer peripheral edge of the small diameter disc portion and a second ring guide unit that is formed upward along the outer peripheral edge of the large diameter disc portion.

3. The remote control transmitting device as set forth in claim 1, wherein:

the case has two or more annular operation units each of which is attached separately and rotatably in rotation around the same rotation center axis, and, has a plurality of rotation angle detecting devices, per each annular operation unit, detecting the rotation angle of the annular operating unit around a rotation center axis; and the entire outline of the surface of the case is covered by an annular operation unit having the largest diameter among the plurality of the annular operating units; and the inputting switch and displaying unit are attached to a surface exposed to an opening at the center side of the annular operation unit having the smallest diameter.

4. The remote control transmitting device as set forth in claim 1, further comprising:

a luminescent displaying device installed to the annular operating units; and wherein the luminescent displaying device produces luminescence in variant colors by control content selected by inputting operation.

5. The remote control transmitting device as set forth in claim 1, wherein:

the transmission device is a RF transmitting module which transmits control data to the controlled device using RF signals.

* * * * *